US006983571B2

(12) United States Patent
Felton

(10) Patent No.: US 6,983,571 B2
(45) Date of Patent: Jan. 10, 2006

(54) COMPOSITE ROOFING PANEL

(75) Inventor: Colin C. Felton, Madison, WI (US)

(73) Assignee: Teel Plastics, Inc., Baraboo, WI (US)

( * ) Notice: Subject to any disclaimer, the term of this patent is extended or adjusted under 35 U.S.C. 154(b) by 275 days.

(21) Appl. No.: 09/966,423

(22) Filed: Sep. 28, 2001

(65) Prior Publication Data

US 2002/0040557 A1 Apr. 11, 2002

Related U.S. Application Data

(60) Provisional application No. 60/236,528, filed on Sep. 29, 2000.

(51) Int. Cl.
*E04D 1/20* (2006.01)

(52) U.S. Cl. ..... 52/309.13; 52/314; 52/316; 52/555; 52/557; 52/558

(58) Field of Classification Search ..... 52/314, 52/316, 557, 558, 559, 309.13, 555, 313, 52/309.1, 518
See application file for complete search history.

(56) References Cited

U.S. PATENT DOCUMENTS

| | | | | | |
|---|---|---|---|---|---|
| 1,447,567 | A | * | 3/1923 | Overbury | 52/478 |
| 1,467,510 | A | * | 9/1923 | Smith, Jr. | 52/557 |
| 1,767,374 | A | * | 6/1930 | Kirschbraun | 427/187 |
| 1,795,913 | A | * | 3/1931 | Weaver | 52/420 |
| 2,096,968 | A | * | 10/1937 | Johnston | 52/558 |
| 3,973,369 | A | | 8/1976 | Smith | |
| 4,015,391 | A | | 4/1977 | Epstein et al. | |
| 4,033,499 | A | | 7/1977 | Butler | |
| 4,070,432 | A | * | 1/1978 | Tamaddon | 264/210.3 |
| 4,070,843 | A | | 1/1978 | Leggiere et al. | |
| 4,096,679 | A | | 6/1978 | Naz | |
| 4,104,841 | A | | 8/1978 | Naz | |

(Continued)

FOREIGN PATENT DOCUMENTS

| | | |
|---|---|---|
| JP | 61141970 | 6/1986 |
| JP | 2036902 | 2/1990 |
| JP | 2209230 | 8/1990 |
| JP | 4081406 | 3/1992 |
| JP | 4236281 | 8/1992 |
| JP | 5201124 | 8/1993 |
| JP | 7233569 | 9/1995 |
| JP | 7295147 | 11/1995 |
| JP | 8209044 | 8/1996 |
| JP | 8269426 | 10/1996 |
| JP | 11131016 | 5/1999 |

OTHER PUBLICATIONS

Enviroshake web site: http://www.enviroshake.com/.

Enviroshake web site page: http://www.enviroshake.com/products.php?PHPSESSID=05726acdf66c64314bf20fb8f5d6267c.

Eco–shake– The remarkable shingle for a healthier environment web site page: http://www.ecoshake.com/.

Lamarite Slate Composite Shingles web site page: http://www.tamko.com/res/lamarite/lamarite.htm.

Parksite.com Home web site page: http://www.parksite.com/buildingproducts/links/ppw enviroshake.html.

*Primary Examiner*—Jeanette E. Chapman
(74) *Attorney, Agent, or Firm*—Foley & Lardner LLP

(57) ABSTRACT

The present invention provides a composite panel for use in construction, and particularly for shingling, which comprises natural fiber and a polymer. Due to its composition and layout the construction panel provides all of the advantages of natural materials and high end roofing materials, particularly an attractive appearance, while at the same time allowing for ease of installation, little or no maintenance requirements, and providing superior impact and fire resistance when compared to other roofing materials. The construction panels can also be installed using conventional equipment and methods similar to the installation of 3-tab asphalt shingles with little or no learning curve.

18 Claims, 3 Drawing Sheets

U.S. PATENT DOCUMENTS 4,189,878 A 2/1980 Fitzgerald
4,219,981 A 9/1980 Stewart et al.
4,251,967 A 2/1981 Hoofe, III
4,288,959 A 9/1981 Murdock
4,343,126 A 8/1982 Hoofe, III
4,382,993 A * 5/1983 McIntyre et al. ..... 428/395
4,434,200 A * 2/1984 Fash et al. ..... 442/46
4,445,301 A 5/1984 Tanski
4,472,913 A 9/1984 Hickman
4,476,661 A 10/1984 Hoofe, III
4,498,267 A 2/1985 Beck
4,499,702 A * 2/1985 Turner ..... 52/555
4,544,595 A 10/1985 Tomason
4,588,634 A 5/1986 Pagen et al.
4,598,522 A 7/1986 Hoofe, III
4,617,770 A 10/1986 Hickman
4,618,440 A 10/1986 Steinberg et al.
4,627,207 A 12/1986 Young et al.
4,641,472 A 2/1987 Young et al.
4,663,373 A 5/1987 Ravichandran et al.
4,671,753 A 6/1987 Payne
4,671,991 A 6/1987 Payne
4,717,614 A 1/1988 Bondoc et al.
4,729,202 A 3/1988 Ferland
4,749,533 A 6/1988 Payne
4,777,776 A 10/1988 Morrell
4,795,661 A 1/1989 Bondoc et al.
4,798,033 A 1/1989 Weidl
4,803,144 A 2/1989 Hosoi
4,825,616 A 5/1989 Bondoc et al.
4,879,333 A 11/1989 Frazee
4,940,844 A 7/1990 Blunt
4,946,992 A 8/1990 Falk et al.
5,039,740 A 8/1991 Anderson et al.
5,047,556 A 9/1991 Köhler et al.
5,084,506 A 1/1992 Faler et al.
5,088,910 A 2/1992 Goforth et al.
5,096,046 A 3/1992 Goforth et al.
5,100,274 A 3/1992 Hasan et al.
5,106,609 A 4/1992 Bolich, Jr. et al.
5,124,098 A * 6/1992 Vischer ..... 264/54
5,126,392 A 6/1992 Nakashima
5,135,971 A 8/1992 Steiert et al.
5,141,983 A 8/1992 Hasegawa et al.
5,186,980 A 2/1993 Koschitzky
5,188,895 A * 2/1993 Nishino et al. ..... 428/373
5,224,318 A 7/1993 Kemerer
5,229,207 A 7/1993 Paquette et al.
5,287,669 A 2/1994 Hannah et al.
5,288,787 A 2/1994 Sackmann et al.
5,295,339 A 3/1994 Manner
5,305,569 A * 4/1994 Malmquist et al. ..... 52/309.8
5,305,570 A 4/1994 Rodriguez et al.
5,344,007 A * 9/1994 Nakamura et al. ..... 206/205
5,347,784 A 9/1994 Crick et al.
5,375,491 A 12/1994 Hannah et al.
5,400,558 A * 3/1995 Hannah et al. ..... 52/559
RE34,951 E 5/1995 Slosberg et al.
5,416,151 A * 5/1995 Tanaka ..... 524/484
5,421,134 A 6/1995 Hannah et al.
5,437,735 A 8/1995 Younan et al.
5,501,056 A 3/1996 Hannah et al.
5,524,412 A 6/1996 Corl
5,537,792 A 7/1996 Moliere
5,575,861 A 11/1996 Younan et al.
5,577,361 A 11/1996 Grabek, Jr. et al.
5,592,799 A 1/1997 Reinke
5,635,125 A 6/1997 Ternes et al.
5,636,481 A 6/1997 De Zen
5,687,090 A 11/1997 Chen et al.
5,731,033 A 3/1998 Hanisco
5,763,083 A * 6/1998 Berrigan ..... 428/402
5,813,184 A 9/1998 McKenna
5,821,294 A 10/1998 Perlinski
5,853,858 A 12/1998 Bondoc
5,922,379 A * 7/1999 Wang ..... 426/138
5,960,596 A 10/1999 Lyons, Sr.
5,992,116 A 11/1999 Ternes et al.
6,038,827 A 3/2000 Sieling
6,058,670 A 5/2000 Sieling et al.
6,092,302 A * 7/2000 Berrigan ..... 34/303
6,105,329 A * 8/2000 Bondoc et al. ..... 52/557
6,114,007 A 9/2000 Brandon et al.
6,153,293 A 11/2000 Dahl et al.
6,180,257 B1 1/2001 Brandt et al.
6,248,813 B1 6/2001 Zehner
6,258,876 B1 7/2001 Medoff et al.
6,361,851 B1 * 3/2002 Sieling et al. ..... 428/144
6,436,471 B1 * 8/2002 Petersen ..... 427/209
6,487,828 B1 * 12/2002 Phillips ..... 52/554
6,550,362 B1 * 4/2003 Galinat et al. ..... 83/23
6,579,605 B2 6/2003 Zehner
6,590,004 B1 7/2003 Zehner

* cited by examiner

COMPOSITE ROOFING PANEL

CLAIM OF PRIORITY

This application claims priority from U.S. Provisional Patent Application No. 60/236,528, filed Sep. 29, 2000.

TECHNICAL FIELD

The present invention relates to construction panels, compositions and methods for making construction panels. More particularly, the present invention relates to construction panels made of natural fibers and polymers and which look like natural and ceramic roof surfacing materials.

BACKGROUND

Natural wood shingles, shakes and ceramic or clay tiles have been used for years to provide roofing and other construction materials. Their pleasing appearance however has to be weighed against the high source, production and installation costs of these materials. In addition, the propensity of wood shakes and shingles or ceramic or clay tiles to deteriorate results in a short lifetime and diminishes their usefulness and other attractive aspects. In fact, due to harsh environmental conditions in different climates, such as wildfires, hail and extreme temperature changes, many construction materials have been found to be completely unworkable or deemed unacceptable because the products do not meet even the minimum safety standards required by law.

Many attempts have been made to produce a commercially feasible process for producing a durable, relatively inexpensive roofing shingle that is easy to install, resistant to weathering, and simulates a wood shake or slate shingle. The need to replace natural materials has led to the development of products which include a variety of synthetic materials such as cement, asbestos, fiberglass, metals and asphalt. The prior art discloses countless examples of laminated asphalt shingle sheets divided into tabs or tongues intended to imitate the subtle variegation of abutting natural shingles and to provide a relatively inexpensive alternative to tile, slate and wood roofing shingles. However, the substantially planar appearance and artificial look of these materials has made them considerably less pleasing to the eye than natural materials. Additionally these materials have useful lifetimes which are much shorter than the structure which they are designed to protect and are made of environmentally unfriendly materials that are not easily amenable to being disposed of or recycled.

In an attempt to depart from the look of artificiality provided by most shingles, high-end recycled products that imitate the appearance of wood shakes or shingles or slate have been produced. Although these products reportedly have long lifetimes and increased environmental friendliness, often these products are expensive to produce and are only capable of imitating the appearance of one type of natural product, either wood or slate, but not both wood and slate. Many types of recycled shingling products require complex installation procedures that can only be performed with special equipment by trained personnel. Additionally, the cost for recycled materials is rising at a rapid pace due to the demand for their use in 'green' products, thus limiting the potential cost benefits of using recycled materials.

None of the prior art examples have solved all the existing needs of the shingling industry. None have produced a durable construction panel providing the look of natural materials, while being versatile, simple to install and cost-effective to produce. Nor do any of the shingles made of recycled materials permit easy installation using commonly available tools standard in the roofing industry.

Thus there remains a need for a rugged durable construction panel that produces the pleasing look of slate, ceramic tiles, wood shakes or shingles, while at the same time being inexpensive and easy to construct from readily available, environmentally friendly materials which is likewise simple and inexpensive to install. There is also a continuing need for a novel material that can be readily be molded into these construction panels. Another need in the construction panel arena includes a desire for a construction panel with a simplified design that includes course-to-course offset marks that result in an easy to install, natural, random appearing surface. Quick installation and a minimum of panel tooling costs will impact considerably on the cost of manufacturing and installing the panel.

SUMMARY OF INVENTION

In one embodiment, the present invention provides a construction panel which comprises an upper portion and a lower portion. The lower portion of the construction panel is characterized by having the appearance of multiple vertically extending members, such as fingers, divided by gaps. The vertically extending members extend from the upper portion of the panel and are of the appropriate size and shape to imitate the appearance of tile, naturally occurring shingles or shakes, or slate. The construction panel itself is made up of at least a polymeric material, for example polyethylene or polypropylene, and a natural fiber, such as wood flour, sugar cane bagasse, hemp, coconut coir, jute, kenaf, sisal, flax, coir pith, rice-hulls, cotton, and combinations thereof. The appearance of the fingers and gaps of the present construction panel can be of varying or non-uniform widths, lengths, or both to give the desired aesthetic appearance sought for the construction panel. The fingers of the construction panel according to the present invention can further have a textured surface exposed to the elements and non-uniform lengths and angled lower edges to better imitate natural products. Materials other than wood can also be imitated by the panels of the present invention including clay, slate, ceramic tile or combinations thereof. The construction panels of the present invention are well suited for attachment to surfaces using conventional tools including nail guns.

In another embodiment, the present invention also provides a material composition for making a construction panel comprising from about 40 percent to 75 percent natural fiber, from about 20 percent to about 60 percent polymeric material, up to about 3 percent coupling agent, up to about 1 percent UV stabilizer, up to about 0.5 percent antioxidant, up to about 2 percent pigment, up to about 5 percent fungicide and up to about 20 percent flame retardant. Suitable fibers include plant fibers such as such as wood flour, sugar cane bagasse, hemp, coconut coir, jute, kenaf, sisal, flax, coir pith, rice-hulls, cotton, and combinations thereof. Suitable polymers include polyethylene, polypropylene and combinations thereof.

Still another embodiment of the present invention provides a method for making the construction panels of the present invention. The method comprises mixing from about 40 to about 75 percent natural fiber and from about 25 percent to about 60 percent polymer to form a molten homogenous mixture, placing the homogenous mixture in an open, cooled mold which has the shape of a construction panel and molding the homogenous mixture by compressing the homogenous mixture into the mold.

DETAILED DESCRIPTION OF THE INVENTION

The present invention is directed to a construction panel and a method for making the same, based on U.S. Provisional Patent Application No. 60/236,528, the entire content of which is hereby incorporated by reference.

Figure 1:
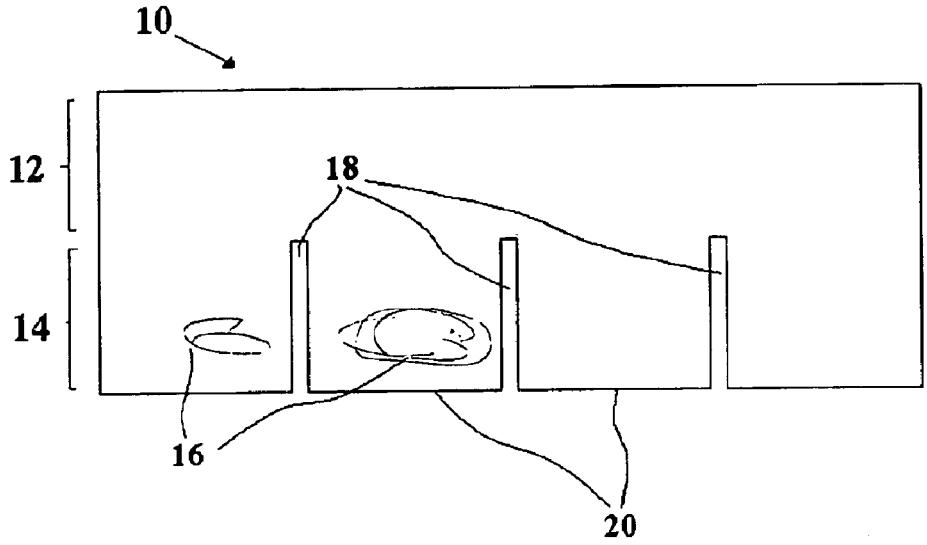
FIG. 1 shows a simulated shake panel in which a natural wood texture is present on the top surface of the panel.

Referring to FIG. 1, one embodiment of a construction panel 10 according to the present invention is shown. Construction panel 10 comprises upper portion 12, or head lap, and a lower portion 14. The lower portion 14 comprises a plurality of vertically extending members 16, such as fingers or tabs, defined by gaps 18, such as cutouts, and butt ends 20.

Preferably, cutouts 18 can be replaced with a web of material so that there is no actual physical separation between the fingers 16, but rather the panel 10 gives the appearance that the fingers are physically separated. In the embodiment when a web of material takes up the gap 18, preferably the web of material is thinner than the connected fingers 16 so that construction panel provides an appearance of depth between the fingers 16 to imitate true gaps. The web of material can be of any suitable thickness and preferably is from about $1/100^{th}$ of an inch thick to about one-half of an inch thick or more depending upon the thickness of the panel itself. More preferably, the web of material is from about one-tenth of an inch thick to about one-quarter of an inch. Most preferably, the web is from about one-fifth of an inch thick to about one-eighth of an inch thick. Desirably, the web of material is thick enough to provide adequate protection yet thin enough to provide sufficient relief between the web of material and the fingers 16 to provide an attractive tree dimensional product. Additionally, the web of material can be darker than the surrounding the fingers 16 to give the appearance of shading. The webs of material consist of the same material and can be formed in the same process in which the panel 10 is made, or the webs can be added to the panel after the construction panel 10 is produced, such as by laminating a sheet of plastic to the underside of the panel. Webs of material between fingers 16 are preferred because the webs prevent natural elements, such as rain, sleet, snow, hail or the like, from directly contacting a course of panels which underly the overlayed course of panels, thus preventing weathering of the underlying course of panels and prolonging the lifetime of the panels.

The portion of the fingers 16 of the lower portion 14 of the panel that are to be viewed are preferably textured to provide the panel with the look and/or feel of other construction materials including clay, ceramics, slate or wood. This is particularly preferable where the panels of the present invention are to be viewed close-up. The texture given to the outer surface of the fingers can be provided by a computer simulation or can be taken from imprints of natural tiles, slates or shakes. Color variation can also be introduced, with or without texturing, into the panel to replicate variegations in natural materials such as wood or slate. Color variation can also give the appearance of texture in non-textured panels.

Because the fingers 16 of panel 10 are of uniform width and length, the embodiment shown in FIG. 1 is most suitable where a construction panel is used to simulate a fairly consistently shaped material, such as tiles, slate or ordinary asphalt shingles.

Figure 2:
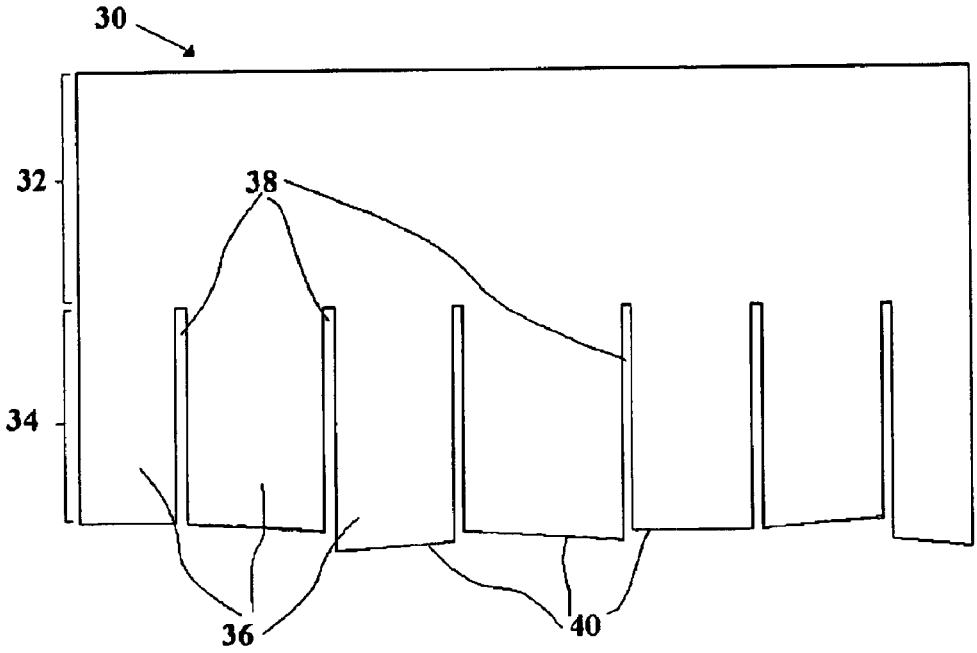
FIG. 2 shows a simulated slate panel having a natural texture on the top surface of the panel.
Figure 3:
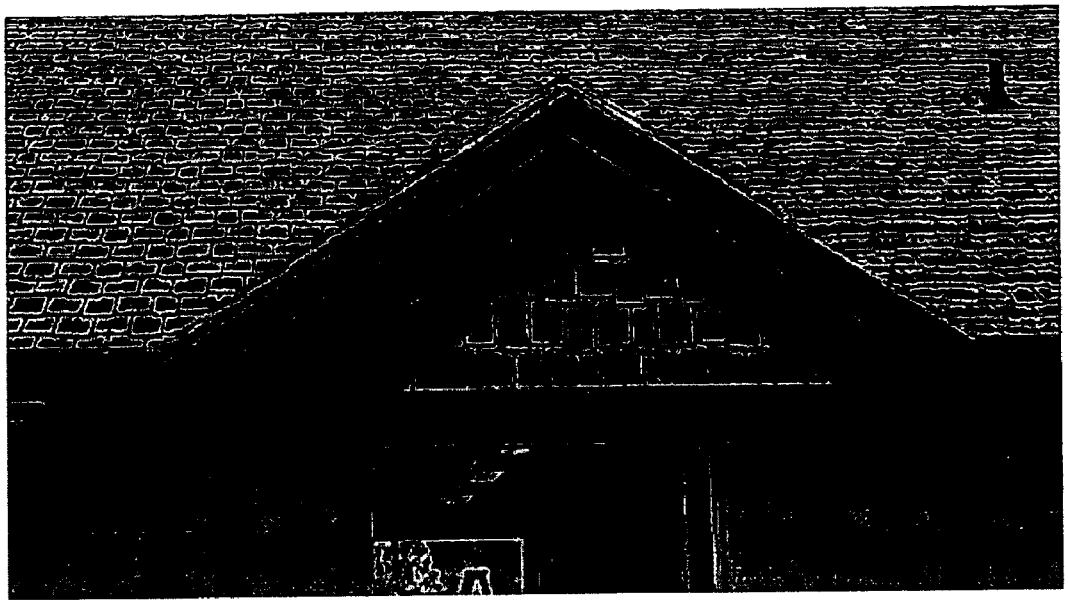
FIG. 3 is a photograph of a building installed with simulated cedar shake panels of the present invention.

Although the fingers 16 are shown in this FIG. 1 as having uniform width, the width of the fingers 16 can vary one from another in order to imitate desired construction materials, and in particular natural wood shakes or shingles. Such an embodiment is depicted in FIG. 2. The construction panel 30 of FIG. 2 is similar to the construction panel of FIG. 1 in that it has an upper portion or head lap 32, and a lower portion 34 comprised of vertically extending members or fingers 34 defined by gaps or cutouts 36 on the vertically extending sides and butt ends 38. Additionally or alternatively, the length of the fingers 36 can vary from finger to finger and the fingers 36 can have non-uniform butt ends 40 to further enhance the natural appearance of the fingers of the panel 30. These non-uniform butt ends 40 can slope to or from one side edge of the fingers to the other edge varying by angle direction and degree. Cutouts 36 can also be of non-uniform width if desired. Although not shown in FIG. 2, the fingers 36 of panel 30 can be of varying width along their lengths, such as where butt end 40 is narrower or wider than the portion of the finger 36 which adjoins the head lap 32. In this embodiment adjoining cutouts 38 will not be parallel with one another. In the panel 30 of FIG. 2 as well, cutouts 38 can be replaced with a web of material as described above.

Similar to the panel in FIG. 1, it is preferred that the portion of the fingers 36 that is to be exposed to the ambient environment, i.e. the outer surface, is textured to give the appearance of wooden shakes, slate, tiles, such as Spanish style tiles, or the like. Because of the non-uniform appearance of the fingers 36, the panel 30 depicted in FIG. 2, is more suitable to replicate the appearance of wooden shingles or shakes. Alternatively or additionally to the texturing described above, the color of the surface of the fingers 36 which is to be exposed to the ambient environment can be variegated to provide a more natural look. The portion of the panel that is not to be exposed to the environment, i.e. the underside, can be patterned with a variety of indentations and ridges to not only stiffen, but also reduce the weight of the panel.

When viewed in cross-section, the thickness of the panels of FIGS. 1 and 2 can tapered from the butt end portion to the head lap portion of the panel, or vice versa. Overall, the entire panel can provide a relief which is as thick as six inches, although the average thickness of the panel preferably ranges from about one-half inch to about one-and-a-half inches thick and more preferably is from about three-quarters of an inch to an inch in thickness. In one embodiment, the thickness of the panel can taper from about three-quarters of an inch, one, two or three inches or more to about one-quarter, one-eighth, or one-sixteenth of an inch or less. This tapering look is preferred where the present panels are meant to replace wood products. Alternatively, the thickness of the panel can be more uniform when giving the appearance of other materials, for example tiles or slate, accounting of course for any texturing on the outer surface of the panel. In another embodiment of the present invention, the head lap portion of the panel can be of uniform thickness while the finger portions of the panel can have a tapering width dimensioned as above, preferably being thickest at the butt end of the finger.

The number of fingers of the present panel can be varied according to the desired design, numbering two, three, four, five, six or seven or more as desired. Preferably, a larger number of fingers, such as four or seven is found on each panel in order to save installation costs. The dimensions of the fingers can be as desired to replicate the appearance of a desired construction material.

Although the panel can be textured on the entire outer surface, preferably the head lap portion is not textured to provide a more even surface on which to overlay subsequent courses of the panels during installation thereby providing a better fit between the subsequent courses of panels.

Although panels according to the present invention can be manufactured in innumerable sizes, preferably the panels are produced in a size which is convenient for handling and installation for one person, generally ranging up to 6 feet wide and 4 feet deep and with relief as high as 6 inches. More preferably, the overall panel dimensions are about three to five feet by about one-and-a-half to two-and-a-half feet and weigh five to fifteen pounds. Most preferably, the panel is about four feet by about two feet.

While the inventive panel thus produces the pleasing look of natural shakes or shingles, other features of the present invention impact upon its considerable economic benefits. In the present panel, offsetting is preferably already built in by virtue of its design which enhances the aesthetic value of the panel. The panel is also inexpensive, easy to construct, simple to install and readily moldable to have varying exterior surface patterns.

In the present invention, the composition of the panel is a mixture of natural non-wood natural fibers and a polymeric material. In particular, the natural fibers are plant fibers, such as wood flour, sugar cane bagasse, hemp, coconut coir, jute, kenaf, sisal, flax, rice-hulls, coir pith and cotton, and combinations thereof, though the present composition is not limited to those fibers. Any suitable natural fiber can be used and preferably is obtained as a byproduct from local agriculture. The polymeric material of the present invention may be polyethylene, either a high or low density version thereof and linear and/or branched versions thereof, polypropylene, polyvinyl chloride, combinations thereof, or other suitable polymers. Preferably, a high proportion of the polymer is obtained from recycled sources.

Though the present invention's preferred composition is a combination of natural plant fibers and a polymeric material such as polyethylene, it will be obvious that the panels can be produced from many varying synthetic compositions well known in the art. A melt flow index (MFI) of between about 0.6 and 10 for the polymer is preferred. A composite material with a polymer having a melt flow of about 7.5 (achieved by mixing 80% 0.6 MFI recycled milk jug flake with 20% 35 MFI HDPE) in combination with 50% wood flour requires a molding pressure of approximately 1000 psi.

Preferred formulations comprise:

(1) between about 40 and 75%, more preferably from about 50 to about 70% and most preferably from about 55 to about 65%, natural plant fibers, (including plant core and dust) from sugar cane bagasse, hemp, coconut coir, jute, kenaf, sisal, flax, wood, rice-hulls, cotton or combinations thereof;

(2) between about 20 and 60%, more preferably from about 20 to about 40% and most preferably from about 20 to about 30%, polymeric material, such as recycled or virgin high and low-density polyethylene;

(3) up to about 1% UV stabilizer, more preferably from about 0.1 to about 0.9% and most preferably from about 0.3 to about 0.5%, such as, for example, benzotriazoles, benzophenones, HALS, or carbon black;

(4) up to about 2%, more preferably from about 0.1 to about 1.5% and most preferably from about 0.3 to about 1%, pigment such as inorganic metal oxides (e.g. $Fe_2O_3$, $Fe_3O_4$, $MnFe_2O_4$, $ZnFe_2O_4$);

(5) up to about 5%, more preferably from about 1 to about 5% fungicide (e.g. $B_2O_3$);

(6) up to 0.5% antioxidant;

(7) up to about 20%, more preferably from about 5 to about 15% and most preferably from about 7 to about 13%, flame retardant, such as sodium octoborate, aluminum trihydrate, aluminum polyphosphate, magnesium hydroxide, boric acid (which also acts as a fungicide), zinc borate, decabromodiphenyloxide, and antimony oxide. Some flame retardants, particularly borates such as sodium octoborate and zinc borate, are suitable both as flame retardants and fungicides;

(8) up to about 10% inorganic filler which can take the place of natural fibers to reduce the heat of combustion of the composition and thus improve fire resistance, such as calcium carbonate, ash or talc (magnesium silicate); and (9) up to about 3 percent coupling agent such as maleic acid grafted polypropylene or polyethylene, more preferably from about 0.5 to about 2.5%, and most preferably from about 1% to about 2.25%.

Preferably, the composition of the present invention has a high amount of fibrous material, exceeding 50%, 55%, 60%, 65% or more. Other suitable materials under these groups can also be substituted as would be understood by one skilled in the art. Preferred natural fibers are those fibers which themselves exhibit some inherent fire resistance, such as those fibers having high silica content or lignin. Preferably the inorganic fillers do not absorb water.

The compositions disclosed herein are capable of being molded into panels having a great detail which can replicate variety of textures, such as wood, slate, tile, and the like. Construction panels made with the compositions of the present invention are also visually attractive because the they weather like real cedar shakes and shingles.

Panels produced according to the present invention offer combinations of any or all of the following advantages: (a) Class A, B, or C fire classification (with A being the highest fire protection rating under UL 790); (b) up to class 3 or 4 impact rating for hail resistance under UL standard 2218 (class 4 of which is the highest hail protection rating); (c) the highest wind uplift rating of as measured by UL standard 580; (d) impact resistance which allows installation with a nail gun without splitting or chipping (particularly at temperatures as low as 10° F.); (e) ease of handling; (f) can be used for steeper slope roof applications (4:12 to 24:12); (g) reduced installation labor costs (takes about half the time taken to install wood shakes, and can be installed using a nail-gun); (h) low installed weight (for example 3 $lb/ft^2$ installed weight); (i) no special framing is required; (j) no special installation tools are required as the materials work like wood; and (k) can be produced in a variety of colors depending only on the colorants added to the formulation.

Construction panels made from the above compositions have been found to have high impact strength. The present construction panels have been shown to have a class 3 or 4 rating according to UL standard 2218, which correspond to dropping 1.75 or 2 inch diameter steel balls from 17 and 20 feet, respectively, on the corners and edges of the panel without causing damage. High impact strength is desirable for construction materials, especially those utilized in the hail region, as more impact resistant materials are less easily damaged, need not be replaced as often and can result in lower insurance rates. Generally, the impact strength of the panel has been found to increase with increased plastic content, molecular weight of the plastic and fiber content, as opposed to particle content. The impact strength of the plastic can be increased by decreasing the melt flow of the plastic. As is well understood by those skilled in the art, the melt flow of a plastic is a measurement of the viscosity of the plastic. The higher the melt flow number, or melt for short, the less viscous the plastic. Generally, low molecular weight plastics are less viscous.

The construction panels of the present invention are also easily moldable according to the disclosed process and possess a high amount of surface detail when textured. The moldability of the present construction panels has been found to be easier with formulations which utilize higher plastic content, higher melt flow plastic, lower molecular weight plastics, fiber which has a higher lignin content, and decreased amounts of filler content.

The construction panels of the present invention can also be formulated to achieve the desired fire protection rating, ranging from Class A to Class C. Overall fire protection is dependent upon two different qualities: resistance to spreading flames and burn through resistance. These properties can be increased by reducing the heat of combustion of the panel material, increasing the lignin content of the fiber, increasing the inorganic filler content, increasing the fiber content, decreasing the plastic content, and increasing the amount of flame retardant, which can be endothermic additives such as aluminum trihydrate and magnesium hydroxide and/or char layer forming additives, such as borates, phosphates and the like.

UV stability of the panels can be increased by increasing the organic and/or the UV stabilizer content of the panel. Weatherability of the panel can be increased by increasing the plastic content, increasing the amount of coupling agent in the panel and/or decreasing the organic filler or fiber content. The cost of the panel can be reduced by utilizing more recycled polymer in the panel and increasing the organic filler or fiber content of the panel. The level of fungicide used in the panel formulation generally depends upon the amount of fiber in the panel and the expected environment in which the panel is used. For example, 5% boric acid can be used with 65% natural fiber and less than 1% boric acid is fine when the formulation contains 40% fiber.

The present invention also provides a method for producing the construction panels according to the present invention. According to this method, a composition described above is mixed or compounded together to form a mixture. Preferably the mixture is a homogenous mixture to provide the panel with consistent quality and characteristics. The materials may be compounded by any mixing means known in the art. Preferably, the materials are compounded together with a twin screw extruder or batch mixer commonly used in the plastics industry at temperatures less than 400° F. Once the material is compounded together the mixture is then extruded in a single screw extruder and placed manually or robotically into an open cooled mold and formed into a construction panel through compression molding. The extruder barrel temperature are set to typically less than 390° F. with polyethylene and polypropylene composites. The extruded mass is placed in the bottom half of a matched metal mold cavity that is set on the bottom platen of a vertically acting hydraulic press. Preferably the mold surface temperature is set to about 200° F. The press should be capable of imposing at least 1000 psi on the molten material to distribute it throughout the mold. Once the mold is closed by the press, the composite material should be cooled just long enough to form a cooled skin on the panel so that the panel can be transported outside the press either robotically or manually. The cooling time can be as low as 15 seconds and is typically 45 to 60 seconds. Compression molding is preferred to form the panels of the present invention because of their high inherent viscosities which are a result of high fiber content. The construction panel formed by the present process preferably has an upper portion and a lower portion. The construction panel produced according to this process can have any shape, size or textured as exemplified above.

A method for installing the construction panels on a surface comprises attaching the upper or head lap portion of a first panel or a first course of panels of the present invention to a surface and overlaying a second panel or second course of panels, respectively, of the present invention over the first panel or course of panels and attaching the upper portion of the second panel or course of panels to the surface. In this manner, the lower portion of the second panel or course of panels overlaps the upper portion of the first panel or course of panels to a degree that at least a portion of the second panel or course of panels overlaps the upper fingers of the first panel or course of panels. The second panel or course of panels can be horizontally offset from the first pane or course of panels as is typical in standard shingling. Additionally, panels of the present invention having different overall widths can be used in this shingling method to a give a more random, natural appearance to the final shingled surface, especially where the panels are intended to simulate wood shakes.

Installation of the inventive panels can thus be easily achieved using conventional tools readily available in the construction industry, such as nail guns, etc. No special techniques or framing is required to install the construction panels and thus there is little or no learning curve for those not familiar with the panels.

EXAMPLES

Example 1

The present example provides a panel having Class A fire resistance according to UL standards. A construction panel consisting of: (a) 57% rice hulls 16/80 mesh; (b) 0.4% UV stabilizer available from Ciba Geigy as 783 FDL (a hindered amine); (c) 0.2% Heat stabilizer available from Ciba Geigy as B225; (d) 1% available from Bayer as bayferrox 645 T brown pigment; (e) 15% Aluminum hydroxide; (f) 2% maleic acid grafted polyethylene (MAPE)—available from Dupont as MB226; (g) 18.7% recycled milk jug flakes (having a melt flow index of about 0.6); (h) 4.7% HDPE (having a melt flow index of about 35); and(i) 1% zinc borate available from U.S. Borax as firebrake ZB, was mixed together to form a homogenous composition. This composition was then placed into a mold and compression molded into a construction panel 43 inches wide, 21.5 inches tall and 0.75 inches thick at its butt end. The panel was comprised of 7 shakes (fingers) resembling hand-split cedar shakes with widths between 4 and 8 inches. The construction panel was then tested for fire resistance according to UL standard 790. The construction panel in this example achieved the highest fire resistance rating, e.g. Class A.

Example 2

This example provides a panel having Class C fire resistance according to UL standards. A construction panel consisting of: (a) 50% rice hulls 16/80 mesh; (b) 0.4% UV stabilizer available from Ciba Geigy as 783 FDL (hindered amine); (c) 0.2% Heat stabilizer available from Ciba Geigy as B225; (d) 1% available from Bayer as bayferrox 645 T brown pigment; (e) 2% maleic acid grafted polyethylene (MAPE) available from Dupont as MB226; (f) 36.3% recycled milk jug flakes (having a melt flow index of about 0.6); (g) 9.1% HDPE (having a melt flow index of about 35); and (h) 1% zinc borate available from U.S. Borax as firebrake ZB, was mixed together to form a homogenous composition. This composition was then placed into a mold and compression molded into a construction panel 43 inches wide, 21.5 inches tall and 0.75 inches thick at its butt end. The panel was comprised of 7 shakes (fingers) resembling hand-split cedar shakes with widths between 4 and 8 inches. The construction panel was then tested for fire resistance according to UL standard 790. The construction panel in this example achieved a Class C fire rating, the rating most commonly required of residential structures in most parts of the country.

Table 1 shows panel formulations and their burn characteristics.

TABLE 1

| Sample | % fiber1 | fiber 1 name | % MAPE | % HDPE1 | HDPE1 melt | % HDPE2 | HDPE2 melt | % additive1 | additive1 name | % additive2 | additive2 name | % additive3 | additive3 name |
|---|---|---|---|---|---|---|---|---|---|---|---|---|---|
| A | 62 | rice hulls | 2 | 24 | 57 | 0 | na | 12 | POLYBOR ® (sodium octaborate) | 0 | na | 0 | na |
| B | 57 | rice hulls | 2 | 24 | 57 | 0 | na | 17 | POLYBOR ® (sodium octaborate) | 0 | na | 0 | na |
| C | 57 | rice hulls | 2 | 24 | 57 | 0 | na | 12 | POLYBOR ® (sodium octaborate) | 5 | ATH | 0 | na |
| D | 57 | rice hulls | 2 | 24 | # | 0 | na | 12 | POLYBOR ® (sodium octaborate) | 5 | Mg(OH) 3 | 0 | na |
| E | 57 | rice hulls | 2 | 24 | 57 | 0 | na | 12 | POLYBOR ® (sodium octaborate) | 5 | CaCO3 | 0 | na |
| F | 50 | 40 mesh maple | 2 | 48 | 57 | 0 | na | 0 | na | 0 | na | 0 | na |
| G | 70 | 40 mesh maple | 2 | 28 | 57 | 0 | na | 0 | na | 0 | na | 0 | na |
| H | 50 | 20 mesh pine | 2 | 48 | 57 | 0 | na | 0 | na | 0 | na | 0 | na |
| I | 70 | 20 mesh pine | 2 | 28 | 57 | 0 | na | 0 | na | 0 | na | 0 | na |
| J | 50 | rice hulls | 2 | 48 | 57 | 0 | na | 0 | na | 0 | na | 0 | na |
| K | 70 | rice hulls | 2 | 28 | 57 | 0 | na | 0 | na | 0 | na | 0 | na |
| L | 57 | rice hulls | 2 | 26 | 57 | 0 | na | 5 | POLYBOR ® (sodium octaborate) | 10.0 | ATH | 0 | na |
| M | 57 | rice hulls | 2 | 26 | 57 | 0 | na | 5 | POLYBOR ® (sodium octaborate) | 10.0 | Mg(OH) 3 | 0 | na |
| N | 57 | rice hulls | 2 | 26 | 57 | 0 | na | 0 | POLYBOR ® (sodium octaborate) | 15.0 | ATH | 0 | na |
| O | 57 | rice hulls | 2 | 26 | 57 | 0 | na | 0 | POLYBOR ® (sodium octaborate) | 15.0 | Mg(OH) 3 | 0 | na |
| P | 57 | rice hulls | 2 | 26 | 57 | 0 | na | 0 | POLYBOR ® (sodium octaborate) | 7.5 | Mg(OH) 3 | 7.5 | ATH |
| Q | 57 | rice hulls | 2 | 4.6 | 57 | 18.40 | jug | 12.00 | POLYBOR ® (sodium octaborate) | 5.0 | Mg(OH) 3 | 1.0 | uv/heat/color |
| R | 61 | rice hulls | 2 | 5.75 | | 17.25 | | 12.58 | POLYBOR ® (sodium octaborate) | 0.0 | | 1.0 | uv/heat/color |
| S | 65 | kenaf | 2 | | | 33 | 57 | | | | | | |
| T | 65 | coir pith | 2 | | | 33 | 57 | | | | | | |
| U | 70 | kenaf | 2 | | | 28 | 57 | | | | | | |
| V | 70 | coir pith | 2 | | | 28 | 57 | | | | | | |
| W | 75 | kenaf | 2 | | | 23 | 57 | | | | | | |
| X | 75 | coir pith | 2 | | | 23 | 57 | | | | | | |

TABLE 1-continued

| Sample | sample thickness (inches) | flame height (inches) | Burn time 1 (sec) for 3" of flame travel | Burn time 2 (sec) for 3" of flame travel | Burn time 3 (sec) for 3" of flame travel | average burn time (sec) for 3" of flame travel | Avg. Burn Rate (mm/min) (UL 94-HB) |
|---|---|---|---|---|---|---|---|
| A | 0.140 | 2 | 206 | 196 | 190 | 197 | 22.8 |
| B | 0.143 | 1 | 202 | 196 | 219 | 206 | 21.9 |
| C | 0.143 | 1 | 239 | 249 | 247 | 245 | 18.4 |
| D | 0.142 | 1 | 250 | 241 | 244 | 245 | 18.4 |
| E | 0.135 | 1 | 231 | 216 | 204 | 217 | 20.7 |
| F | 0.132 | no | 162 | 146 | 142 | 150 | 30.0 |
| G | 0.175 | no | 169 | 180 | 188 | 179 | 25.1 |
| H | 0.129 | no | 152 | 134 | 187 | 158 | 28.5 |
| I | 0.145 | no | 220 | 169 | 180 | 190 | 23.7 |
| J | 0.133 | no | 156 | 146 | 145 | 149 | 30.2 |
| K | 0.170 | no | 200 | 183 | 188 | 190 | 23.6 |
| L | 0.145 | 1.5 | 230 | 200 | 217 | 215.7 | 20.9 |
| M | 0.146 | 1.5 | 211 | 245 | 232 | 229.3 | 19.6 |
| N | 0.153 | 1.5 | 269 | 269 | 255 | 264.3 | 17.0 |
| O | 0.164 | 2 | 391 | 356 | 380 | 375.7 | 12.0 |
| P | 0.155 | 2 | 348 | 343 | 347 | 346 | 13.0 |
| S | 0.140 | 4 | 230 | 222 | 186 | 212.7 | 21.2 |
| T | 0.136 | 4 | 223 | 235 | 211 | 223 | 20.2 |
| U | 0.170 | 3 | 219 | 221 | 204 | 214.7 | 21.0 |
| V | 0.155 | 3 | 238 | 289 | 266 | 264.3 | 17.0 |
| W | 0.190 | 3 | 243 | 238 | 259 | 246.7 | 18.2 |
| X | 0.168 | 3 | 311 | 331 | 344 | 328.7 | 13.7 |

Table 2 shows various formulations suitable for use in the present invention.

TABLE 2

| Fiber variations | | | | | | |
|---|---|---|---|---|---|---|
| 50% Kenaf | 2% MAPE coupling agent (maleic acid grafted polyethylene) | 0.4% Ciba Geigy 783 FDL (hindered amine UV stabilizer) | 0.2% Ciba Geigy B-225 (heat stabilizer) | 0.4% Bayer Iron Oxide red pigment (Bayferrox 130 M) | 10% 44 Melt HDPE (Quantum LS34200-00) | 37% Recycled Milk Jugs (as flakes, HDPE) |
| Rice hulls or Jute, or Hemp Cor, or Hemp Fiber, or Flax Shive or Flax Fiber, or Wood flour or Wood Fiber (Kraft, TMP/Newsprint) or Coconut husk fiber (coir) or coconut husk pith or Agave (Sisal) | Same as above | Same as above | Same as above | Same as above | Same as above | Same as above |
| Fiber Loading variations | | | | | | |
| 40% Hemp Fiber | 2% MAPE | 0.4% UV stabilizer | 0.2% heat stabilizer | 0.4% Bayferrox 645T brown pigment (manganese ferrite) | | 57% Milk jug flake |

TABLE 2-continued

| | | | | | | |
|---|---|---|---|---|---|---|
| 75% Kenaf | 2% MAPE | 0.4% UV stabilizer | 0.2% heat stabilizer | 0.4% Bayferrox 645T brown pigment (manganese ferrite) | 23% 44 melt HDPE | |
| Resin variations | | | | | | |
| 50% rice hulls | 1% MAPE | 0.4% UV stabilizer | 0.2% heat stabilizer | 0.4% Bayferrox 645T brown pigment (manganese ferrite) | 48% mix of linear low density polyethylene (LLDPE) and low density polyethylene (LDPE) from recycled stretch wrap and plastic bags | |
| 50% rice hulls | 1% MAPE | 0.4% UV stabilizer | 0.2% heat stabilizer | 0.4% Bayferrox 645T brown pigment (manganese ferrite) | | 48% 44 melt HDPE (copolymer or homopolymer) |
| Fiber Dimension Variations | | | | | | |
| 50% 140 Mesh Maple wood flour | 2% MAPE | 0.4% UV stabilizer | 0.2% heat stabilizer | 0.4% Bayferrox 645T brown pigment (manganese ferrite) | 47% 44 melt HPDE | |
| 50% 10 mesh maple wood flour | 2% MAPE | 0.4% UV stabilizer | 0.2% heat stabilizer | 0.4% Bayferrox 645T brown pigment (manganese ferrite) | 47% 44 melt HPDE | |
| Fiber Flame Retardent Variations | | | | | | |
| 50% rice hulls | 2% MAPE | 0.4% UV stabilizer | 0.2% heat stabilizer | 0.4% Bayferrox 645T brown pigment (manganese ferrite) | 10% Sodium Octaborate (U.S. Borax POLYBOR ®), applied as aqueous solution to rice hulls | 37% 44 melt HDPE |
| 50% rice hulls | 2% MAPE | 0.4% UV stabilizer | 0.2% heat stabilizer | 0.4% Bayferrox 645T brown pigment (manganese ferrite) | 10% (Ammonium Polyphosphate (Albright & Wilson Antiblaze TR), applied as aqueous solution to rice hulls | 37% 44 melt HDPE |
| Plastic Flame Retardent Variations | | | | | | |
| 50% rice hulls | 2% MAPE | 0.4% UV stabilizer | 0.2% heat stabilizer | 0.4% Bayferrox 645T brown pigment (manganese ferrite) | 10% Aluminum Trihydrate (Huber Micral 1500) | 37% 44 melt HDPE |

TABLE 2-continued

| | | | | | | |
|---|---|---|---|---|---|---|
| 50% rice hulls | 2% MAPE | 0.4% UV stabilizer | 0.2% heat stabilizer | 0.4% Bayferrox 645T brown pigment (manganese ferrite) | ZeroGen 50 Micral 1500 -ATH, 10% Magnesium Hydroxide (Huber ZeroGen 1500) | 37% 44 melt HDPE |
| 50% rice hulls | 2% MAPE | 0.4% UV stabilizer | 0.2% heat stabilizer | 0.4% Bayferrox 645T brown pigment (manganese ferrite) | 10% Zinc Borate (U.S. Borax Firebrake ZB) | 37% 44 melt HDPE |
| 50% rice hulls | 2% MAPE | 0.4% UV stabilizer | 0.2% heat stabilizer | 0.4% Bayferrox 645T brown pigment (manganese ferrite) | 10% Decabromodiphenyloxide (Albermarle Co.), 5% Antimony oxide (Laurel Industries) | 37% 44 melt HDPE |

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above.

All percentages discussed herein are percentages by weight unless otherwise specified.

All references disclosed herein, including professional standards, such as UL standards, and particularly patents, are specifically incorporated into this application by reference thereto.

While preferred embodiments have been illustrated and described, it should be understood that changes and modifications can be made therein in accordance with ordinary skill in the art without departing from the invention in its broader aspects as defined in the following claims.

What is claimed is:

1. A construction panel comprising:

(a) an upper portion; and (b) a lower portion, wherein said lower portion provides the appearance of a plurality of vertically extending members wherein each of said vertically extending members is an appropriate size and shape to provide the appearance of a shingle, shake or a tile;

wherein the panel comprises:

(i) from about 40 percent to 75 percent natural plant fiber;

(ii) from about 20 percent to 60 percent of a synthetic polymer, (iii) up to about 3 percent coupling agent;

(iv) up to about 0.5 percent antioxidant;

(v) up to about 2 percent pigment;

(vi) up to about 5 percent fungicide;

(vii) up to about 10 percent inorganic filler; and (viii) up to about 20 percent flame retardant.

2. The panel of claim 1 wherein the plurality of members have non-uniform width, non-uniform length, or both non-uniform width and non-uniform length.

3. The panel of claim 1, wherein the plurality of vertically extending members further comprise non-uniform lower edges.

4. The panel of claim 1, wherein the lower portion of the panel further comprises a textured surface.

5. The panel of claim 4, wherein the textured surface replicates the appearance of a material selected from the group consisting of wood, clay, ceramic, slate, tile and combinations thereof.

6. The panel of claim 1, wherein the fiber is selected from the group consisting of wood flour, sugar cane bagasse, hemp, coconut coir, jute, kenaf, sisal, flax, coir pith, rice-hulls and cotton, and combinations thereof.

7. The panel of claim 1, wherein the polymeric material is polyethylene, polypropylene and combinations thereof.

8. The panel of claim 7 wherein the polyethylene is selected from low density polyethylene, high density polyethylene, linear low density polyethylene and linear high density polyethylene.

9. The panel of claim 17 wherein adjacent members of the plurality of vertically extending members are connected together by a web of material.

10. The construction panel of claim 1, wherein the panel comprises from about 50 to about 70 percent natural plant fiber and from about 20 to about 40 percent of a synthetic polymer.

11. The construction panel of claim 1, wherein the panel is a homogenous composition.

12. The panel of claim 1, wherein the construction panel has an impact razing of class 3 or 4 under UL standard 2218.

13. The panel of claim 1, wherein the construction panel has a class A, B, or C fire classification UL standard 790.

14. The panel of claim 1 wherein the plurality of members have uniform widths and lengths.

15. The panel of claim 1 wherein the panel has two to seven vertically extending members.

16. The panel of claim 1 wherein the panel is up to about six feet by four feet.

17. The construction panel of claim 1, wherein said lower portion comprises a plurality of vertically extending members wherein each of said vertically extending member is an appropriate size and shape to provide the appearance of a shingle, shake or a tile.

18. A construction panel comprising:

(a) an upper portion; and (b) a lower portion, said lower portion comprising a plurality of vertically extending members wherein each of said vertically extending members is an appropriate size and shape to provide the appearance of a shingle, shake or tile;

wherein the panel comprises (i) from about 40 percent to 75 percent natural plant fiber;

(ii) from about 20 percent to 60 percent of a synthetic polymer;

(iii) up to about 3 percent coupling agent;

(iv) up to about 0.5 percent antioxidant;

(v) up to about 2 percent pigment;

(vi) up to about 5 percent fungicide;

(vii) up to about 10 percent inorganic filler; and (viii) up to about 20 percent flame retardant.

* * * * *

UNITED STATES PATENT AND TRADEMARK OFFICE

CERTIFICATE OF CORRECTION

PATENT NO. : 6,983,571 B2
DATED : January 10, 2006
INVENTOR(S) : Colin C. Felton It is certified that error appears in the above-identified patent and that said Letters Patent is hereby corrected as shown below:

Column 16,
Line 2, delete "razing" and replace it with -- rating --.

Signed and Sealed this

Thirtieth Day of May, 2006

JON W. DUDAS
*Director of the United States Patent and Trademark Office*

UNITED STATES PATENT AND TRADEMARK OFFICE

CERTIFICATE OF CORRECTION

PATENT NO. : 6,983,571 B2
APPLICATION NO. : 09/966423
DATED : January 10, 2006
INVENTOR(S) : Colin C. Felton It is certified that error appears in the above-identified patent and that said Letters Patent is hereby corrected as shown below:

Title page Item [73]
The assignee listed on the cover page of the patent should be changed from "Teel Plastics, Inc." to --Teel-Global Resource Technologies, LLC--.

Signed and Sealed this

Twenty-second Day of May, 2007

JON W. DUDAS
*Director of the United States Patent and Trademark Office*